United States Patent [19]

Kwok et al.

[11] Patent Number: 4,660,774

[45] Date of Patent: Apr. 28, 1987

[54] FLUID NOZZLE LOCKING MECHANISM

[75] Inventors: Kui-Chiu Kwok, Arden Hills; Robert J. Lind, Robbinsdale, both of Minn.

[73] Assignee: GRACO INC., Minneapolis, Minn.

[21] Appl. No.: 737,823

[22] Filed: May 23, 1985

[51] Int. Cl.[4] ..... B05B 5/02

[52] U.S. Cl. ..... 239/708; 239/301; 239/600

[58] Field of Search ..... 239/290, 294–301, 239/600, 696, 705, 708

[56] References Cited

U.S. PATENT DOCUMENTS

| | | | |
|---|---|---|---|
| 290,790 | 12/1883 | Nerney . | |
| 349,724 | 9/1886 | Kyle . | |
| 359,385 | 3/1887 | Dambach et al. . | |
| 805,298 | 11/1905 | Johnson . | |
| 1,081,661 | 12/1913 | Dashner et al. . | |
| 1,717,086 | 6/1929 | Binks . | |
| 1,800,262 | 4/1931 | Mueller | 239/301 |
| 1,849,300 | 3/1932 | Jenkins | 239/301 |
| 1,873,625 | 8/1932 | Munz | 239/301 |
| 1,910,673 | 5/1933 | Bramsen | 239/300 |
| 1,962,911 | 6/1934 | Roselund | 239/301 |
| 3,625,424 | 12/1971 | Mantica | 239/708 |
| 4,171,096 | 10/1979 | Welsh et al. | 239/301 |

*Primary Examiner*—Andres Kashnikov
*Assistant Examiner*—Michael J. Forman

[57] ABSTRACT

In a fluid spray gun, the fluid nozzle is threadedly attached to the gun body and is covered by an air cap and threaded retaining ring. A latching mechanism is placed in the gun body and removably latches the toothed nozzle in place to prevent rotation due to friction from the air cap and retaining ring. The latch is held in place by the air cap and/or retaining ring but is easily disengaged when the air cap and retaining ring are removed.

3 Claims, 3 Drawing Figures

FLUID NOZZLE LOCKING MECHANISM

BACKGROUND OF THE INVENTION

Spray guns of various types for years have utilized a relatively conventional construction wherein the fluid nozzle is threadedly attached to the gun body, and has located on top thereof an air cap which is retained by a threaded retaining ring to the gun body. The air cap frictionally engages a portion of the face of the nozzle. Thus, when the operator of the spray gun wishes to reorient the pattern from horizontal to vertical or vice-versa, typically he loosens the retaining ring and rotates the air cap to the desired position and thereafter tightens the retaining ring. The problem with such constructions has typically been that, when the operator rotates the air cap to the new desired position, such rotation frictionally engages the nozzle and loosens the nozzle relative to the gun body. This can result in pressurized fluid from the fluid passage leaking around the normally tight seal between the nozzle and gun body and thence into the air passages of the gun where it can eventually cause clogging or other damage to parts of the gun, such as the electronics present in a number of electrostatic spray guns.

While the use of pins is known to prevent rotation of nozzle parts, as shown by U.S. Pat. No. 1,962,911, the prior art has not advanced any solution towards this problem of the relative turning of threaded pieces within one another and, yet, which may be easily disassembled for cleaning and the like or for a change of nozzles.

It is therefore an object of this invention to provide some sort of manner for preventing rotation of the nozzle relative to the gun body and yet which may be easily released for cleaning or part exchange. It is a further object of this invention to provide such a locking mechanism which may be easily adapted to pre-existing spray guns without extensive tooling or the like, and which may be inexpensively manufactured.

It is yet a further object of this invention to provide such a locking mechanism that will remain locked, unless and until the spray cap and retaining ring are removed.

SUMMARY OF THE INVENTION

A typical fluid spray gun is provided with a body having generally two threaded concentric areas at the front thereof. On the inner-threaded member, the fluid nozzle is generally threadedly attached and receives fluid from a fluid passage for spraying. Outside the nozzle and its associated threaded area, but within the outer threaded area, are one or more cavities and/or passages which are cast, molded or otherwise formed within the gun body itself. At least one of these cavities or passages may serve to conduct air from an air source farther in the gun to the air cap, which will be attached over a second threaded area. In the instant invention, one of the cavities is utilized to hold a complementary-shaped block, which in turn has a cylindrical opening therein parallel to the fluid axis for receiving a latch member. The fluid nozzle is provided with a plurality of evenly spaced teeth about the periphery thereof, those teeth having notches therebetween for receiving one or more projections on the latch member. The latch member may be rotated into and out of contact and engagement with the teeth and the recesses therebetween. The latch member is movable between a first position engaging the teeth, and a second position free of engagement. The latch member is desirably held in the aforementioned first position by the air cap and/or retaining ring when those are applied to the gun body. Thus, if the user loosens the retaining ring to reposition the air cap, the latch member will remain engaged thereby totally preventing rotation of the nozzle relative to the gun body and assuring a continued seal, thereby preventing fluid leakage into the air passages of the gun.

These and other objects and advantages of my invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
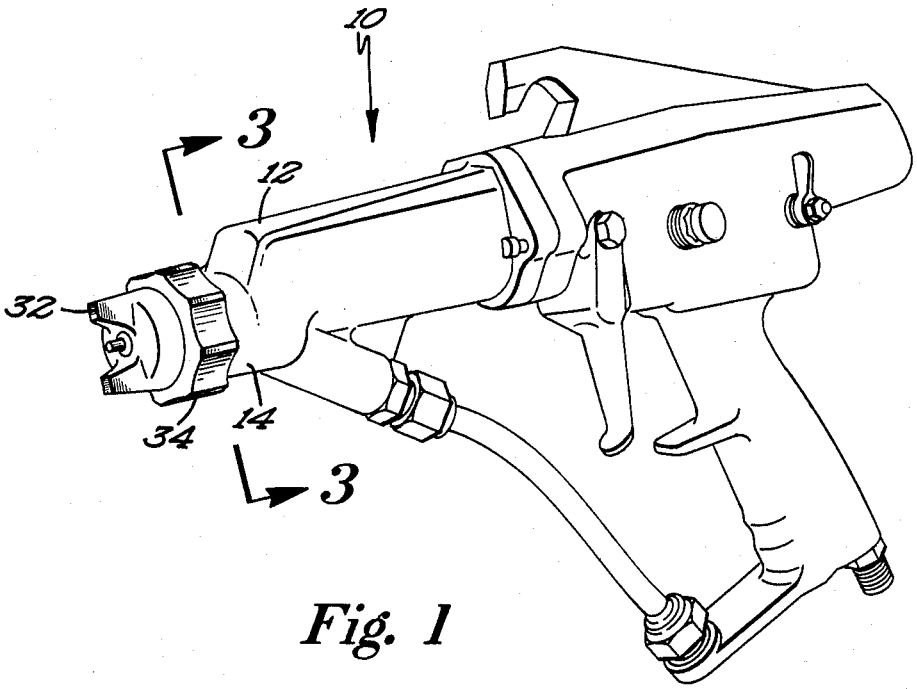
FIG. 1 is a perspective view showing a gun utilizing the instant invention.
Figure 2:
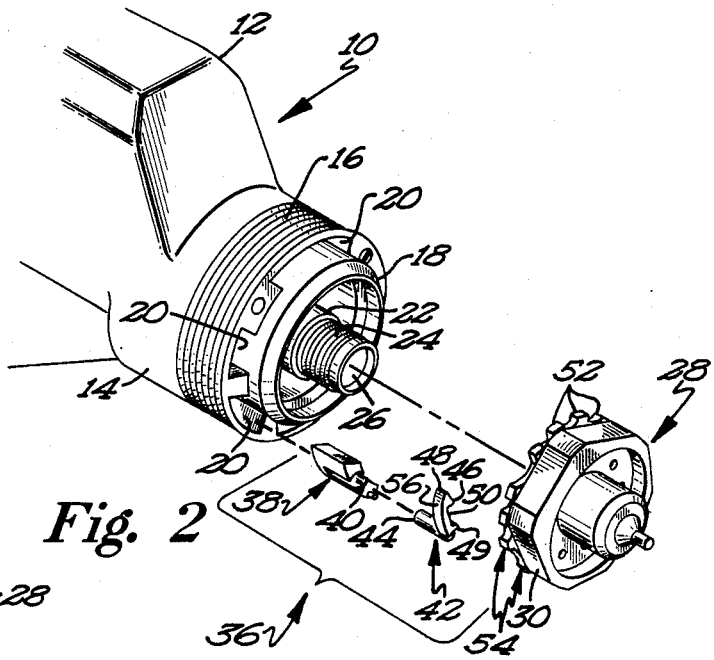
FIG. 2 is an exploded view of the latch of the instant invention along with the nozzle and a portion of the gun body.
Figure 3:
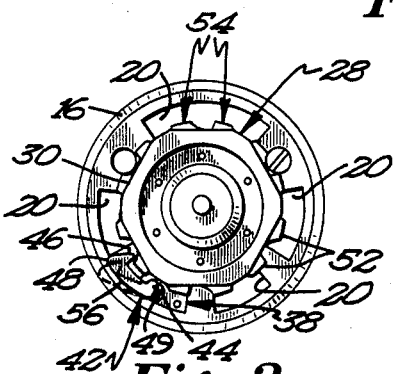
FIG. 3 is a sectional view taken along line 3—3 of FIG. 1.

The instant invention is generally designed for use with a spray gun 10 having a front body portion 12 which, in turn, has a cylindrical surface 14 at the front thereof having threads 16 thereon. An inner barrel member 18 is spaced from outer member 14 to form cavities 20 therebetween. Cavities 20 are either used to convey air to the air cap or result from the molding or other forming process. A fluid passage member 22 extends concentrically through inner barrel 18 and has threads 24 thereon about a fluid passage 26. Nozzle 28 threadedly engages threaded portion 24 and is provided with finger grips 30 by use in loosening and tightening nozzle 28.

Air cap 32 fits over the front of nozzle 28 and is held in place by a retaining ring 34. Retaining ring 34 is threadedly engaged with threaded portion 16 on gun body 12.

A locking assembly 36 is generally utilized to secure nozzle 28 to gun body 12. Locking assembly 36 is comprised generally of a pivot block 38, a latch member 42 and teeth 52. Pivot block 38 is sized to be slideably located in one of cavities 20. A pivot hole 40 is located in pivot block 38 and has an access parallel to the axis of nozzle 28. Latch means is provided by block 38 and latch member 42, which has a cylindrical pivot rod 44 and a first projection 46. A finger manipulation point 48 is located on the distal end of latch member 42 and enables a user to easily disengage latch member 42. A second projection 49 is located adjacent to pivot rod 44 and engaging between teeth 52. A recess 50 is located between first and second projections 46 and 49 in order to straddle one of teeth 52. Teeth 52 generally act as latching engaging means and are separated by recesses 54 located between the teeth. Ideally, teeth 52 are evenly spaced throughout the circumference of nozzle 28 in order to provide an easily adjustable locking mechanism 36 for removably retaining nozzle 28. The outer surface 56 of latch member 42 is held in place and restrained by the inner surface of air cap 32 and/or retaining ring 34, thereby preventing the latch member 42 from moving to the second or open position, and thus retaining the latch member 42 in the first or locked position as long as the air cap 32 and retaining ring 34 remain on the gun.

It is contemplated that various changes and modifications may be made to the fluid nozzle locking mechanism without departing from the spirit and scope of the invention as defined by the following claims.

What is claimed is:

1. A fluid nozzle locking mechanism for spray guns comprising a fluid nozzle rotatably and threadedly mounted on a gun body, and an air cap rotatably mounted on said body and clampingly retained thereto by a retaining ring rotatably and threadedly mounted to said body over said nozzle, said locking mechanism comprising:

a latch on said body intermediate said retaining ring and said nozzle and movable between first and second positions, said latch comprising a latch member rotatably located in said gun body, said latch member comprising a pivot shaft rotatably located in gun body, a first projection adjacent said shaft, and a second projection circumferentially spaced around said nozzle from said first projection, said projections engaging said nozzle in said first position; and latch engaging means on said nozzle said latch being located between said nozzzle and said retaining ring wherein said latch interacts with said latching engaging means in said first position to prevent rotation of said nozzle relative to said body, said latch being rotatable to said second position wherein said nozzle is free to rotate, relative to said body and wherein said latch is retained in said first position by said retaining ring when said retaining ring is on said body and requiring removal of said retaining ring to rotate said latch to said second position.

2. The locking mechanism of claim 1 wherein said spary gun is electrostatic.

3. The locking mechanism of claim 1 wherein said nozzle comprises an axis of spray and rotation and said latch rotates about an axis parallel to said nozzle axis.

* * * * *